US011203216B2

(12) United States Patent
Kreilhuber et al.

(10) Patent No.: US 11,203,216 B2
(45) Date of Patent: Dec. 21, 2021

(54) STAMP WITH PIVOTABLE STAMPING INSERT AND EXCHANGEABLE INK CARTRIDGE

(71) Applicant: Trodat GmbH, Wels (AT)

(72) Inventors: Ronald Kreilhuber, Marchtrenk (AT); Helmut Lindner, Peuerbach (AT)

(73) Assignee: Trodat GmbH

( * ) Notice: Subject to any disclaimer, the term of this patent is extended or adjusted under 35 U.S.C. 154(b) by 0 days.

(21) Appl. No.: 16/970,168

(22) PCT Filed: Feb. 13, 2019

(86) PCT No.: PCT/AT2019/060054

§ 371 (c)(1),
(2) Date: Aug. 14, 2020

(87) PCT Pub. No.: WO2019/157546

PCT Pub. Date: Aug. 22, 2019

(65) Prior Publication Data

US 2021/0178793 A1 Jun. 17, 2021

(30) Foreign Application Priority Data

Feb. 15, 2018 (AT) ..... A 50141/2018

(51) Int. Cl.
*B41K 1/36* (2006.01)
*B41K 1/42* (2006.01)
*B41K 1/10* (2006.01)

(52) U.S. Cl.
CPC . *B41K 1/42* (2013.01); *B41K 1/10* (2013.01)

(58) Field of Classification Search
CPC ... B41K 1/10; B41K 1/12; B41K 1/40; B41K 1/42; B41K 1/02; B41K 1/54; B41K 1/36
(Continued)

(56) References Cited

U.S. PATENT DOCUMENTS 4,255,801 A 3/1981 Ode et al.
5,649,485 A 7/1997 Dour et al.
(Continued)

FOREIGN PATENT DOCUMENTS

AT 006732 U1 3/2004
AT 503827 A1 1/2008
(Continued)

OTHER PUBLICATIONS

International Search Report from Application No. PCT/AT2010/000020 dated Aug. 5, 2010, pp. 1-5.
(Continued)

*Primary Examiner* — Leslie J Evanisko
(74) *Attorney, Agent, or Firm* — Lerner, David, Littenberg, Krumholz & Mentlik, LLP

(57) ABSTRACT

The technology is relates to a stamp with a pivotable stamping insert. The stamp includes a top part with a pair of side faces; a bottom part; a receiving device for an exchangeable ink cartridge with pad having grip elements and a stamping insert with a text plate positioned in the bottom part. The stamping insert is configured to move in a vertical direction from a resting position into a stamping position for producing a stamp impression by the text plate by means of a reversing mechanism. The reversing mechanism includes a reversing opening on a rear side of the top part for the stamping insert, and on each side face of the pair of side faces there is one grip opening for reaching through to the bottom part to the grip elements of the exchangeable ink cartridge with pad.

5 Claims, 4 Drawing Sheets

(58) Field of Classification Search
USPC ..... 101/334
See application file for complete search history.

(56) References Cited

U.S. PATENT DOCUMENTS

| | | | |
|---|---|---|---|
| 5,743,186 | A | 4/1998 | Liao |
| 6,526,882 | B1 | 3/2003 | Shih |
| 6,877,426 | B1 | 4/2005 | Huang |
| 6,945,172 | B1 | 9/2005 | Shih |
| 7,380,497 | B2 | 6/2008 | Faber |
| 2004/0250719 | A1 | 12/2004 | Sculler |
| 2005/0145127 | A1 | 7/2005 | Zindl et al. |
| 2006/0144267 | A1 | 7/2006 | Moody |
| 2006/0185539 | A1 | 8/2006 | Faber |
| 2007/0272099 | A1 | 11/2007 | Pointl |
| 2008/0148975 | A1 | 6/2008 | Faber |
| 2011/0277647 | A1 | 11/2011 | Zindl et al. |
| 2014/0196622 | A1 | 7/2014 | Shih |

FOREIGN PATENT DOCUMENTS

| | | | |
|---|---|---|---|
| DE | 202004010164 | U1 | 8/2004 |
| DE | 202006001417 | U1 | 4/2006 |
| EP | 0873245 | A1 | 10/1998 |
| EP | 1507666 | A1 | 2/2005 |
| EP | 2384283 | B1 | 4/2013 |
| EP | 2591919 | B1 | 12/2013 |
| EP | 2591920 | B1 | 2/2014 |
| EP | 2591921 | B1 | 2/2014 |
| JP | H066848 | U | 1/1994 |
| WO | 0183227 | A1 | 11/2001 |
| WO | 0183228 | A1 | 11/2001 |
| WO | 2003099572 | A1 | 12/2003 |
| WO | 2005084953 | A2 | 9/2005 |
| WO | 2010085828 | A2 | 8/2010 |

OTHER PUBLICATIONS

International Search Report from PCT/AT2019/060054 dated Jun. 26, 2019; 3 pages.

International Preliminary report on Patentability for PCT/AI2019/060054 dated Apr. 9, 2020; 5 pages.

STAMP WITH PIVOTABLE STAMPING INSERT AND EXCHANGEABLE INK CARTRIDGE

CROSS-REFERENCE TO RELATED APPLICATIONS

The present application is a national phase entry under 35 U.S.C. § 371 of International Application No. PCT/AT2019/060054 filed Feb. 13, 2019, published in German, which claims priority from Austria Patent Application No. A50141/2018 filed Feb. 15, 2018, all of which are incorporated herein by reference.

BACKGROUND

The present invention relates to a stamp with a pivotable stamping insert, comprising at least a top part, a bottom part and a stamping insert preferably with a text plate, wherein a receiving device for an exchangeable ink cartridge with pad is arranged in the bottom part, and the stamping insert can be moved in the vertical direction from a resting position, in which the text plate preferably abuts against the stamp pad, into a stamping position for producing a stamp impression by the text plate, and the stamping insert is rotatable in the vertical direction by approx. 180° via a reversing mechanism.

BRIEF SUMMARY

The stamp according to the present invention is a derivative of the originally developed stamp with the designation "Printy 4.0" according to EP2 591 919 B, EP 2 591 920 B, EP 2 384 283 B and EP 2 591 921 B, so that not all details are dealt with in the description, but only the essential differences or further developments, respectively, are described. Any missing details, such as the attachment of the ink cartridge with pad, etc., can therefore be taken from the documents referred to.

The essential drawback of the original stamp is that in such a self-inking stamp, which is preferably made of plastic, the cap-like top part encloses the bottom part, so that only stamping inserts that can be swivelled within the bottom part by preferably 180° can be used. Moreover, the bottom part is completely closed, wherein it is possible to look through transparent surfaces into the interior space, especially for positioning on a surface.

The objective of the present invention is on the one hand to avoid the above disadvantages and on the other hand to maintain user-friendliness. Furthermore, the objective is to expand the field of application of the stamp.

The objectives are achieved by the invention.

The objectives are achieved by a stamp in which a rear side of the top part has a reversing opening for the stamping insert arranged in the bottom part, and that on either side face of the top part there is one grip opening each for reaching through to the bottom part, in particular to grip elements of an inserted ink cartridge with pad, which extends to the rear side of the top part and opens into a removal opening which runs over the entire length of the rear side, so that the two lateral grip openings on the side faces are connected via the removal opening on the rear side.

An advantage here is that it is thus possible that in the area of the reversing opening the stamping insert can swing to the outside from the interior space of the bottom part during reversing, especially swivelling. This makes it possible that in such a stamp the stamping insert is equipped with an AB unit (assembled band unit). Such AB units, which are preferably equipped in the shape of a date, are usually formed larger in construction size, especially in construction height, than the possible width of the interior in the bottom part is, so that reversing or swivelling, respectively, is not possible without a special embodiment. Therefore, date stamps are usually offered only for office stamps or round stamps where the top part does not significantly enclose the bottom part.

Another important advantage is that the ink cartridge replacement according to the present invention with laterally arranged grip elements on the ink cartridge with pad could be maintained.

In another advantageous embodiment, the reversing opening is connected to the removal opening running on the rear. This ensures that a continuous open area is formed on the rear, via which the stamping insert can be swivelled during a stamping process. This means that even unusually high AB units can be installed, as the removal opening for the ink cartridge with pad can also be included in the rotary movement.

In advantageous embodiments, preferably two guide elements are arranged on the top part that limit the reversing opening laterally and at the same time guide the bottom part. This ensures that the bottom part is held in position by the guide elements.

In another advantageous embodiment, the guide elements extend from the side faces to the rear. This ensures that a cap-like receiving area is created in which the bottom part can be received and guided.

In an advantageous embodiment, the guide elements on the rear side extend in the marginal area, especially over a short length. This ensures that the guide elements simultaneously guide the bottom part and limit the reversing opening.

In an advantageous embodiment, the bottom part has an opening on the side where the reversing opening in the top part is located for swivelling out the stamping insert. This ensures that the stamping insert can swivel to the outside from the interior space of the bottom part into the reversing opening and thus a preferably 180° rotation with an AB unit can be used in a plastic self-inking stamp.

In an advantageous embodiment, each ink cartridge with pads has one grip element arranged on either side face for laterally holding and pulling the ink cartridge with pad out of the stamp, in particular via the grip openings, wherein the grip elements are designed for introduction into a recess in the bottom part of the stamp and these do not project beyond the outer surface of the bottom part, so that the top part of the stamp is movable via the recess with the grip elements inserted in the bottom part. This ensures that easy and especially clean ink cartridge replacement can be performed, as the ink cartridge with pad is gripped with two fingers on the lateral grip elements and can thus be pulled out of or inserted into the stamp. Thanks to the lateral grip position of the fingers, the user is never at risk of touching the ink-filled pad inside the ink cartridge with pad.

In another advantageous embodiment, a lock is provided on the top part, wherein the lock is designed to fix the grip openings in a locking position aligned relative to the recess in the bottom part for removal or introduction of the ink cartridge with pad, preferably with further blocking positions, for example for gluing on the text plate in the stamping position. This ensures that upon exchange of the ink cartridge with pad or other activities, such as gluing on the text plate, which is preferably made of rubber or silicone rubber, respectively, the stamp can be fixed in a defined position so that it no longer needs to be held in this position. This allows the desired activity to be performed easily afterwards.

Finally, in another advantageous embodiment the guide elements are connected to each other via a connecting web, wherein the connecting web separates the reversing opening and the removal opening from each other. This ensures that the two guide elements are stabilised in relation to each other and there is nevertheless a reversing opening at the rear.

The invention is described hereinafter in the form of exemplary embodiments, wherein attention is drawn to the fact that the invention is not limited to the exemplary embodiments or solutions, respectively, represented and described.

DETAILED DESCRIPTION

Figure 4:
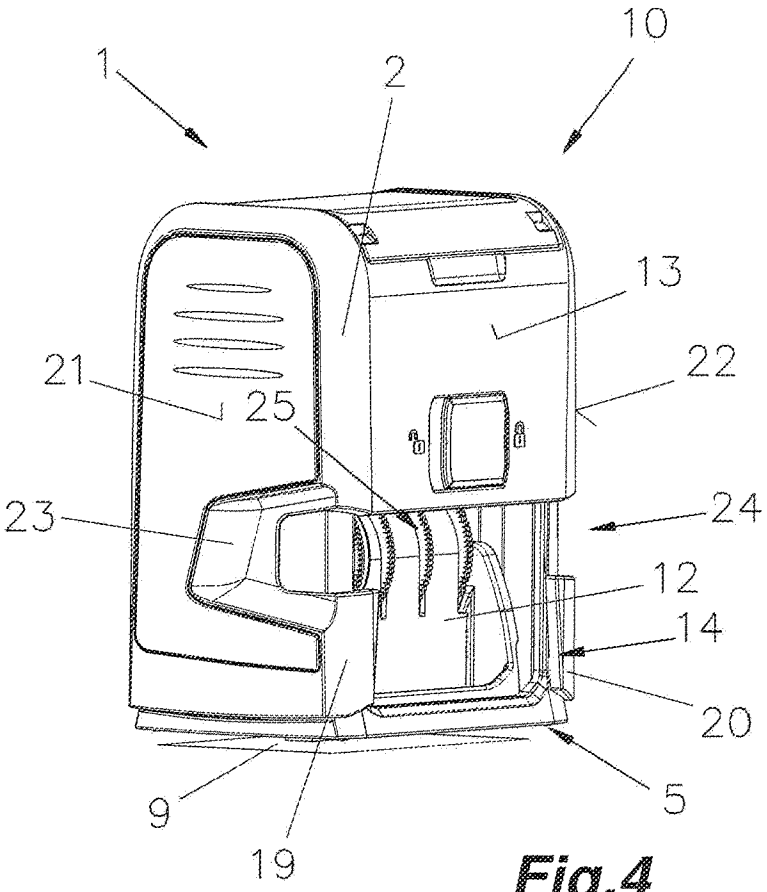
FIG. 4—schematic illustration of the stamp in the stamping position; simplified, for illustrative purposes only.

It should be stated by way of introduction that, in the individual embodiments, the same parts are provided with the same reference numbers or same component designations, respectively, wherein the disclosures contained in the entire description can, by analogy, be transferred to identical parts with identical reference numbers or identical component designations, respectively. The position details selected in the description, such as, e.g., top, bottom, lateral, etc., likewise relate to the figure described, and in the event of a change of position, they are to be transferred to the new position by analogy. Individual features or feature combinations from the exemplary embodiments shown and described may also represent independent inventive solutions.

FIGS. 1 to 6 show a stamp 1, in particular a so-called self-inking stamp 1, which is preferably made entirely of plastic. Only the spring used for the return movement is preferably made of metal.

The stamp 1 according to the present invention comprises at least a top part 2, a bottom part 3 and a stamping insert 4 preferably with a text plate 5. A receiving device 6 for an exchangeable ink cartridge with pad 7 is provided in the bottom part, wherein the receiving device 6 is formed, for example, by a shaft or guide receptacles in which the ink cartridge with pad 7 is positioned. In a resting position 8, the text plate 5 attached to the stamping insert 4 abuts against a pad impregnated with ink on the ink cartridge with pad 7, so that the text plate 5 can adsorb ink for creation of a stamp impression 9, as shown schematically in a stamping position 10, stamp 1 in FIG. 4. This means that the stamping insert 4, which is arranged in the bottom part 3 and coupled to the top part 2, can be moved in the vertical direction from the resting position 8, at which preferably the text plate 5 abuts against the ink cartridge with pad 7, into the stamping position 10 for producing the stamp impression 9 by the text plate 5, and the stamping insert 4 is rotatable by approx. 180° via a reversing mechanism 11.

For the sake of completeness, it is pointed out that the stamp 1 shown here is a further development of the previously mentioned documents according to the present invention is involved, so that further details can be taken from the same.

According to the present invention, stamp 1 was further developed so that an AB unit 12 (assembled band unit) can be used, i.e. by embodiment of the AB unit 12 in the form of a date, i.e. a year tape, a month tape and two day tapes, stamp 1 can also be used as date stamp 1.

To make this possible, a reversing opening 14 is arranged on a rear side 13 of the top part 2. At the same time, correspondingly the bottom part 3 is also formed open on its rear side 15, and the bottom part 3 has an opening 16, respectively. This means that the AB unit 12 arranged on the stamping insert 4 can swivel to the outside during a stamping process via the opening 16 in the bottom part 3 and the reversing opening 14 in the top part 2 in order to be able to carry out the rotation preferably by 180°, as can be seen in FIGS. 1 to 4, in particular in FIGS. 2 and 3. From this it can be seen that protruding parts of the AB unit 12 may protrude beyond the outer surfaces of the top parts 2 and bottom parts 3. If such an AB unit 12 were used in the conventional stamp 1, as known from the state of the art, the AB unit 12 would, as its height 17 is greater than a width 18 of an interior space of the bottom part 3, collide with the rear 15 of the bottom part 3 or, if the bottom part 3 is open, at the latest at the top part 2 and stop the reversing process of the stamping insert 4 with the AB unit 12 mounted on it. However, thanks to the arrangement of the opening 16 in the bottom part 3 and especially the reversing opening 14 in the top part 2, the protruding parts of the AB unit 12 can now simply pass through it to the outside and complete the reversing process.

However, in order to achieve sufficient stability to guide the bottom part 3 over the top part 2 of the stamp 1, the top part 2 has two guide elements 19,20 on each side of the rear side 13. Here, the two guide elements 19,20 limit the reversing opening 13 laterally. Concomitantly, the guide elements 19,20 enclose the bottom part 3 in the resting position 8. As can be seen, the guide elements 19,20 partially enclose the bottom part 3, so that the bottom part 3, especially in the resting position 8, in which the top part 2 is mainly held in position by the guide elements 19,20 only, cannot fold away laterally over the reversing opening 14. During a stamping process, the cap-shaped top part 2 is pushed further and further over the bottom part 3, so that the guiding functions of the guide elements 19,20 are no longer so essential.

Furthermore, the stamp 1 has one grip opening each 23,24 on either side face 21,22 of the top part 2 for reaching through to the bottom part 2. The grip openings 23,24 extend to the rear side 13 of the top part 2 and open into a removal opening 25, which runs over the entire length 26 of the rear side 13, so that the two lateral grip openings 23,24 on the side faces 21,22 are connected via the removal opening 25 on the rear side 13. It is therefore possible to use an ink cartridge with pad 7 as known and protected by patents EP 2 591 919 B, EP 2 591 920 B, EP 2 384 283 B and EP 2 591 921 B. A grip element 29,30 for laterally holding and pulling the ink cartridge with pad 7 out of the stamp 1, in particular via the grip openings 23,24, is arranged on either of the side faces 27,28 of the ink cartridge with pad 7, wherein the grip elements 29,30 are designed for introduction into a recess 31,32 of the bottom part 3 of the stamp 1 and these do not project beyond the outer surface 33 of the bottom part 3, so that the top part 2 of the stamp 1 is movable via the recess 31,32 with the grip elements 29,30 or ink cartridge with pad 1, respectively, inserted into the bottom part 3. Such an exchange of the ink cartridge with pad is shown schematically in FIGS. 4 and 5, wherein in FIG. 4 the stamp 1 is fixed in a removal position 34, in which the top part 2 is pressed down until the guide elements 19,20 release the ink cartridge with pad 7. This means that the ink cartridge with pad 7 can now be easily pulled out or pushed in, wherein in FIG. 6 the ink cartridge with pad was only partially pulled out.

Figure 1:
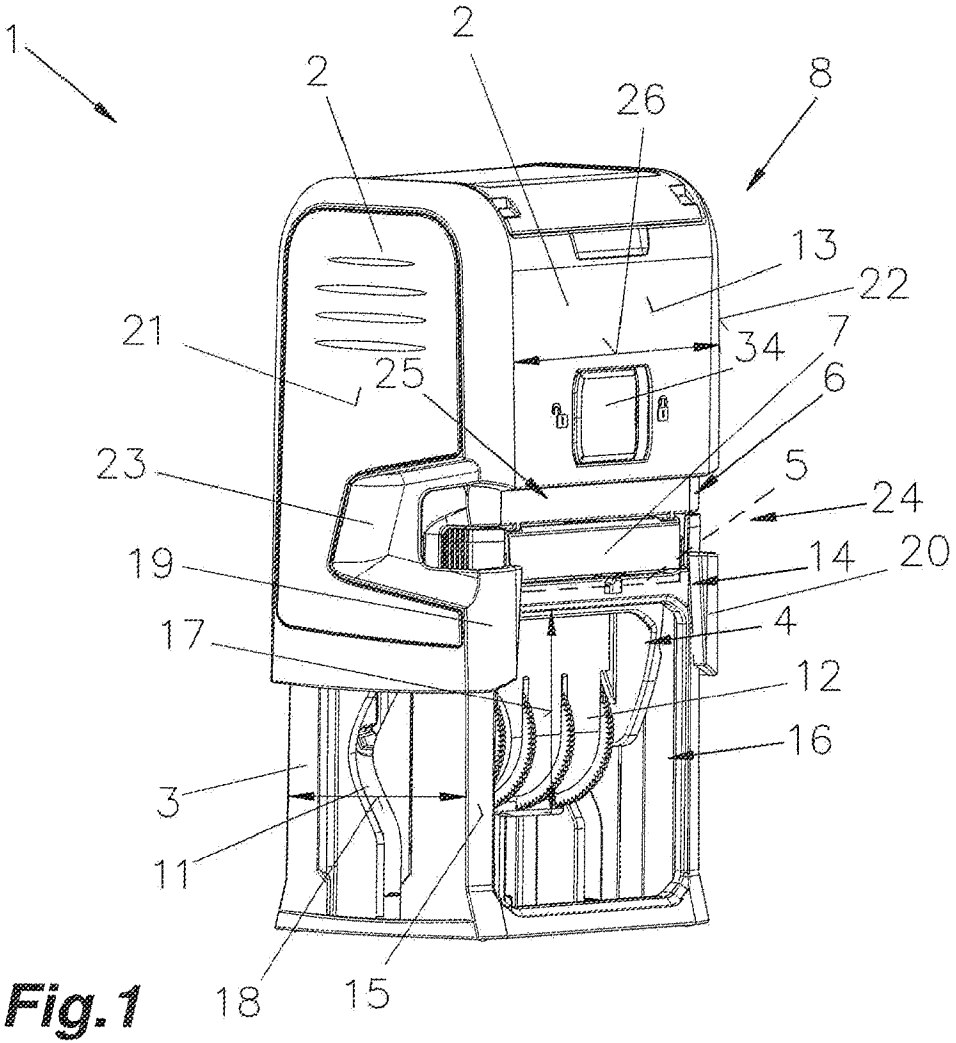
FIG. 1—schematic illustration of a stamp in the resting position, simplified, for illustrative purposes only.
Figure 3:
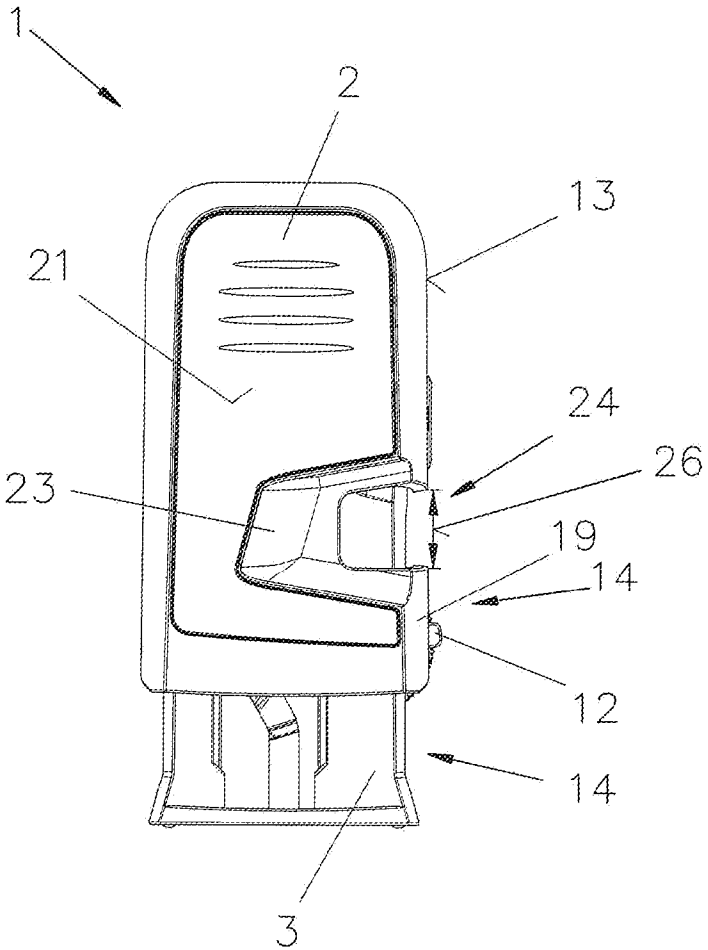
FIG. 3—longitudinal view of the stamp in the position according to FIG. 2; simplified, for illustrative purposes only.
Figure 2:
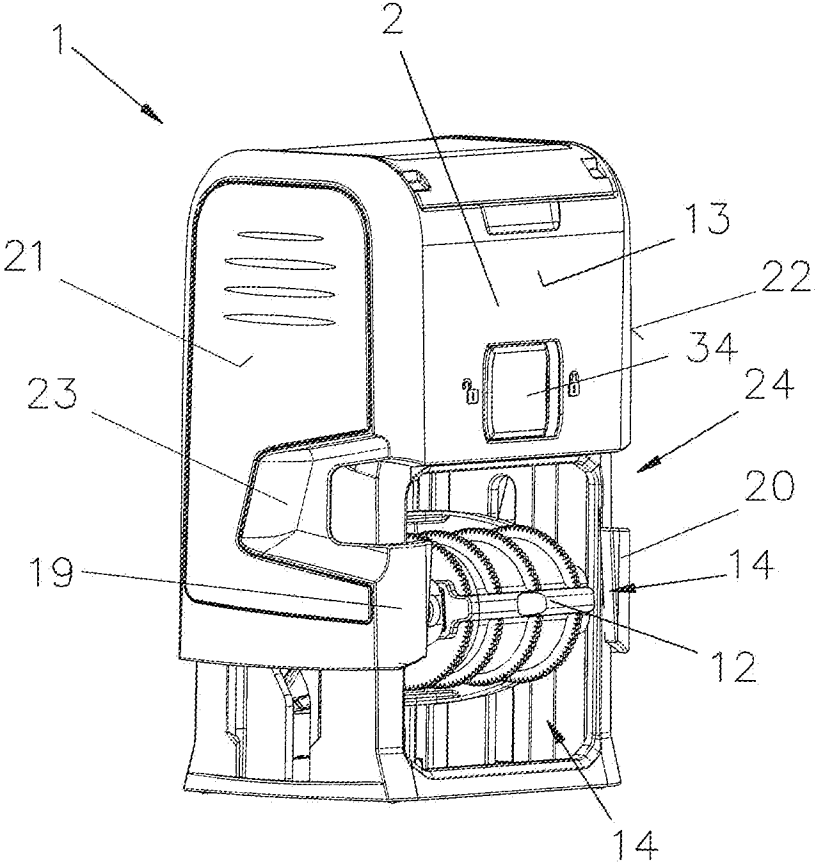
FIG. 2—schematic illustration of the stamp during a stamping process; simplified, for illustrative purposes only.
Figure 6:
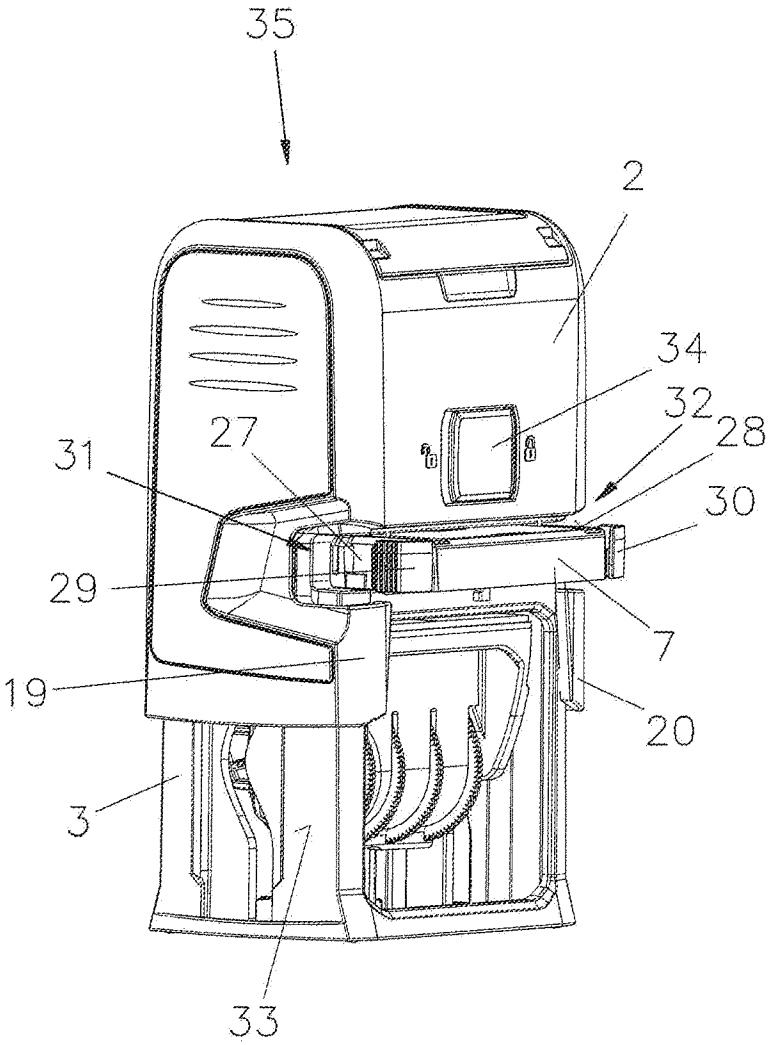
FIG. 6—schematic illustration of the stamp according to FIG. 5 with ink cartridges partially pulled out; simplified, for illustrative purposes only.
Figure 5:
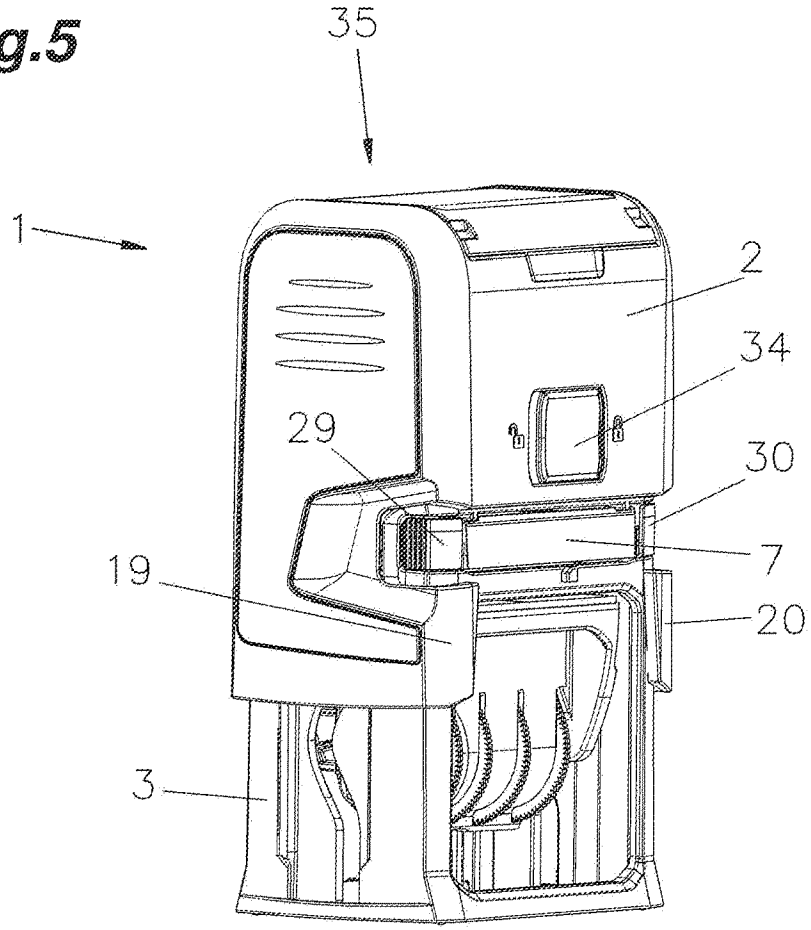
FIG. 5—schematic illustration of the stamp in the ink cartridge exchange position; simplified, for illustrative purposes only.

This also shows and describes another function, where the guide elements 19,20 protect the ink cartridge with pad 7 from falling out in the resting position 8. This is achieved in such a way that, as can be seen in FIG. 1, the guide elements 19,20 partially protrude over the ink cartridge with pad 7 when it is pushed in and thus the ink cartridge with pad 7 cannot fall out or be pulled out. For this purpose, as described above, the stamp 1 must be slightly compressed so that the guide elements 19,20 are located below the ink cartridge with pad 7 and now the grip openings 23,24 and the removal opening 25 are correspondingly aligned and can thus be easily pushed in or out.

However, to obviate the need for holding the stamp 1 in position during an ink cartridge with pad change, it has a lock 34 on the top part 2. The lock 34 is designed to fix the top part 2 to the bottom part 3, wherein in a locking position 35 for the exchange of the ink cartridge with pad, the grip openings 23,24 are in an aligned position relative to the recess 31,32 in the bottom part 3 and thus the ink cartridge with pad 7 can be removed or inserted. Of course, other locking positions, for example for gluing on the text plate 5, can also be designed.

On the stamp 1 shown in FIGS. 1 to 6, the reversing opening 14 is selected so that it connects with the removal opening 25, so that on the rear side 13 there is an enlarged area for the reversing process of the stamping insert 4, in particular of the AB unit 12.

Figure 7:
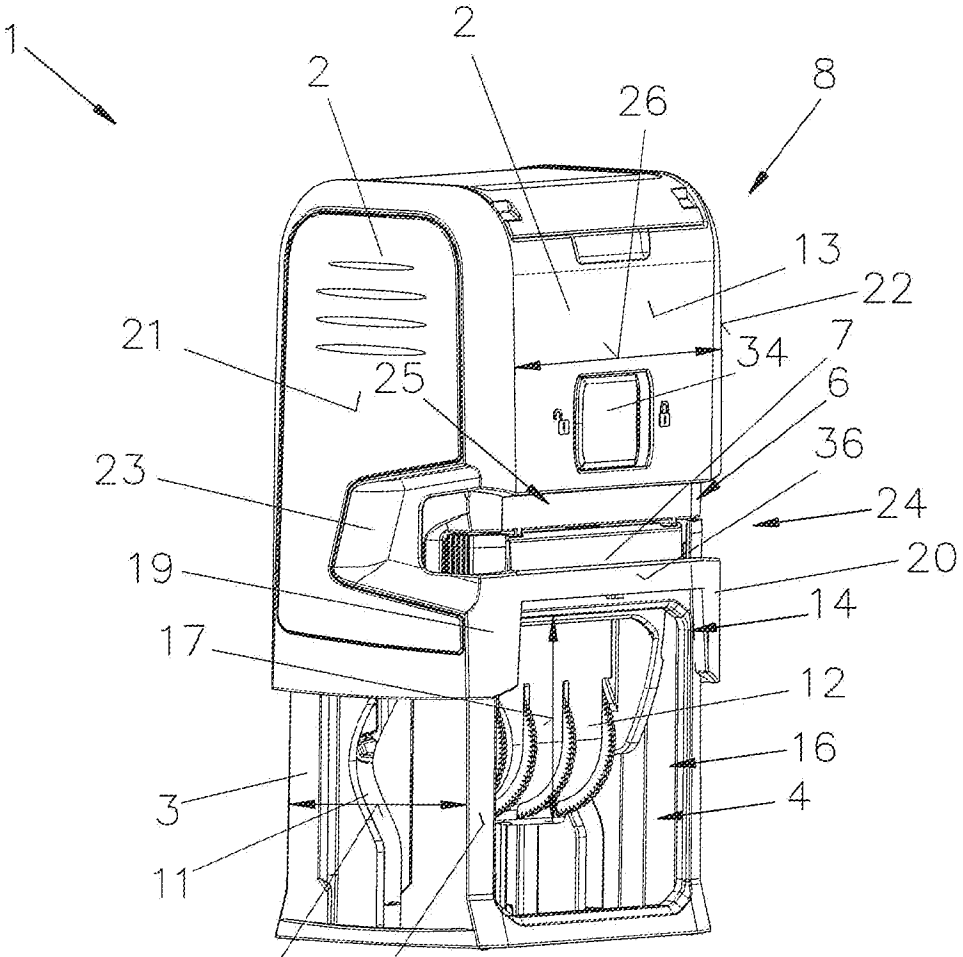
FIG. 7—schematic illustration of another exemplary embodiment with a connecting web between the guide elements; simplified, for illustrative purposes only.

However, it is also possible to have the reversing opening 14 and the removal opening 25 separated by a connecting web 36, as shown in FIG. 7. Such a design is possible if the stamping insert 4, especially its height 17, is designed in such a way that there is sufficient space for reversing within the reversing opening 14.

As a matter of form, it should finally be emphasized that, for the better understanding of the structure of the stamp 1 and its components or constituent parts, respectively, the same have in part been represented not to scale and/or enlarged and/or reduced in size, and above all only schematically.

The invention claimed is:

1. A Stamp with a pivotable stamping insert, comprising:

a top part with a pair of side faces;

a bottom part defining an interior space and having an opening on a rear side;

a receiving device for an exchangeable ink cartridge with pad having grip elements, the receiving device being provided in the bottom part;

a stamping insert with a text plate positioned in the bottom part, the stamping insert configured to move in a vertical direction from a resting position in which the text plate abuts against the ink cartridge with pad, into a stamping position for producing a stamp impression by the text plate, the stamping insert being rotatable by means of a reversing mechanism, wherein the reversing mechanism includes a reversing opening on a rear side of the top part for the stamping insert, and on each side face of the pair of side faces there is one grip opening for reaching through to the bottom part to the grip elements of the exchangeable ink cartridge with pad, each grip opening extending onto the rear side of the top part and opening into a removal opening which extends over the entire length of the rear side, so that the grip openings on each the side face are connected via the removal opening on the rear side, and wherein the reversing mechanism is configured to position at least a portion of the stamping insert outside of the opening on the rear side of the bottom part and the reversing opening on the rear side of the top part during rotation of the stamping insert, such that the portion of the stamping insert extends beyond the interior space.

2. The stamp according to claim 1, wherein the reversing opening is connected to the removal opening on the rear side.

3. The stamp according to claim 1, wherein two guide elements are arranged on the top part, which laterally delimit the reversing opening and at the same time guide the bottom part.

4. The stamp according to claim 1, wherein one grip element of the grip elements is arranged on a first side face of the ink cartridge with pad and a second grip element of the grip elements is arranged on a second side face of the ink cartridge with pad, the grip elements configured for laterally holding and pulling the ink cartridge with pad out of the stamp via the grip openings, wherein the grip elements are designed for introduction into a recess of the bottom part of the stamp and the grip elements do not project beyond the outer surface of the bottom part, so that the top part of the stamp is movable over the recess with the grip elements introduced in the bottom part.

5. The stamp according to claim 1, wherein a lock is arranged on the top part, wherein the lock is formed to fix the grip openings in a locking position aligned relative to the recess in the bottom part for removal or introduction of the ink cartridge with pad.

* * * * *